United States Patent [19]

Meenan

[11] Patent Number: 4,570,804

[45] Date of Patent: Feb. 18, 1986

[54] ADJUSTABLE TRAY FOR VIDEO DISPLAY TERMINALS

[76] Inventor: Vincent D. Meenan, 25 Millbrook Dr., Middletown, N.J. 07748

[21] Appl. No.: 620,576

[22] Filed: Jun. 14, 1984

[51] Int. Cl.[4] ..... A47F 3/14

[52] U.S. Cl. ..... 211/126; 211/88

[58] Field of Search ..... 211/126, 71, 72, 73, 211/88, 135, 175, 153, 201

[56] References Cited

U.S. PATENT DOCUMENTS

| | | | |
|---|---|---|---|
| 883,001 | 3/1908 | Curtis | 211/88 |
| 2,303,098 | 11/1942 | Waldo | 211/126 |
| 2,685,372 | 8/1954 | Palaith | 211/135 X |
| 3,169,640 | 2/1965 | Favre | 211/126 |
| 3,655,063 | 4/1972 | Landry | 211/71 |
| 3,760,534 | 9/1973 | Choux et al. | 211/71 X |
| 4,036,369 | 7/1977 | Eisenberg | 211/88 |
| 4,500,146 | 2/1985 | Peterson | 211/175 X |

*Primary Examiner*—Ramon S. Britts
*Assistant Examiner*—Sarah A. Lechok Eley
*Attorney, Agent, or Firm*—Leo C. Krazinski

[57] ABSTRACT

An expandable two-piece tray mountable upon a video display terminal having either a top or side vent for exhausting air from its motor. The tray is adaptable for storing operational instructions of the terminal including program books, diskettes and the like in both upper and side compartments thereof.

6 Claims, 5 Drawing Figures

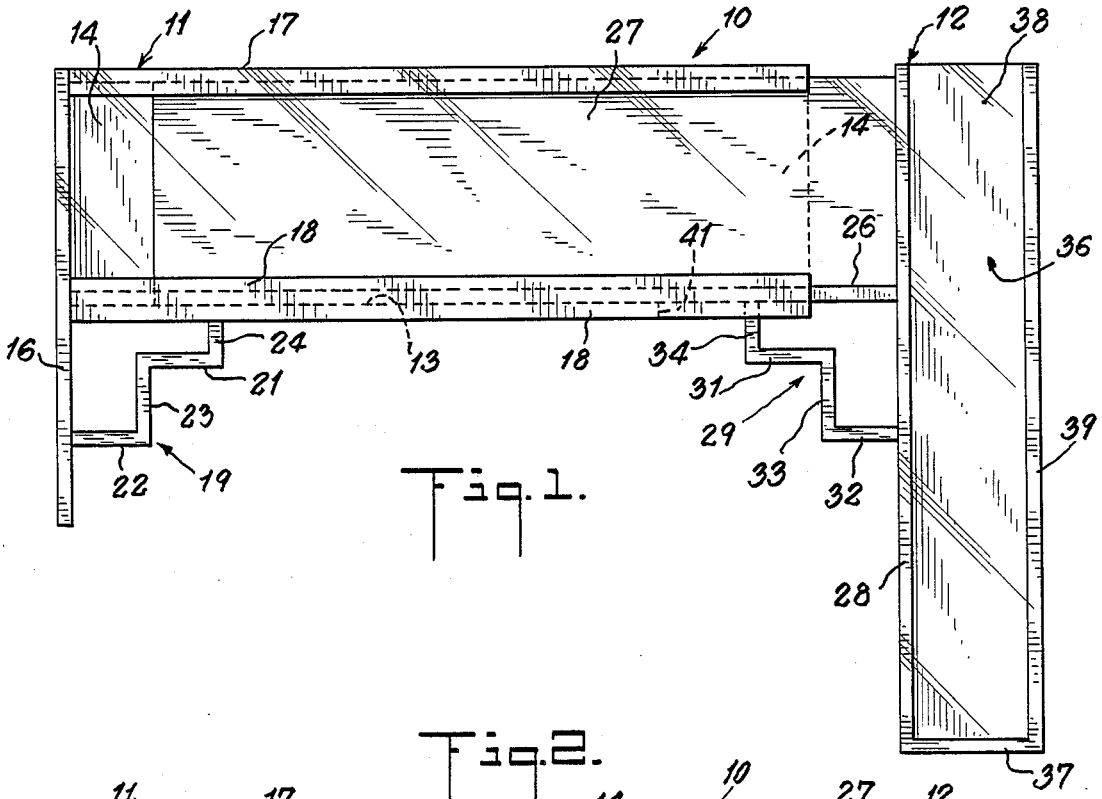
Fig. 1.
Fig. 2.
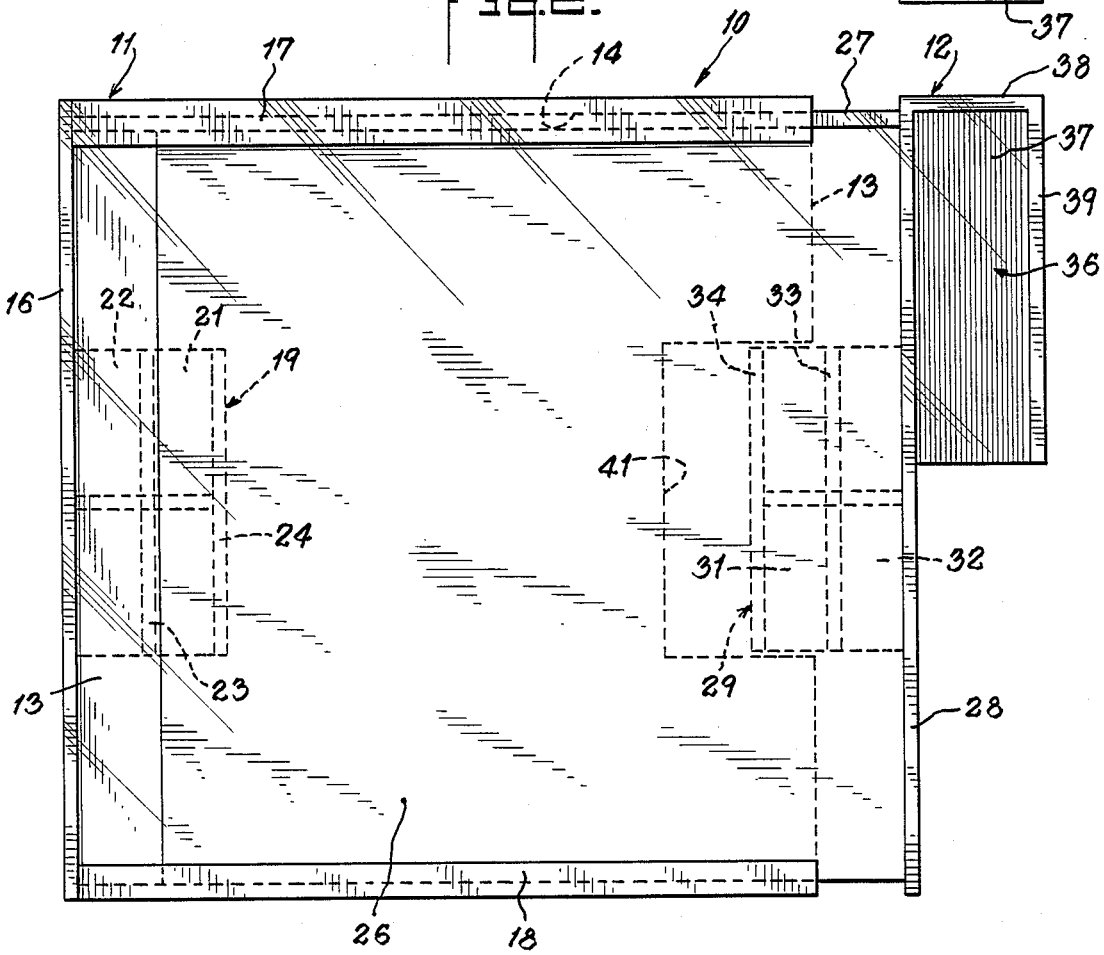

ADJUSTABLE TRAY FOR VIDEO DISPLAY TERMINALS

BACKGROUND OF THE INVENTION

1. Field of the Invention

The present invention relates to office trays and, more particularly, to improved trays that can be adjusted to contract or expand in accordance with the physical outline of the video display terminal with which it is associated.

2. Description of Prior Art

Heretofore, it has been conventional practice to provide trays that are single, as in U.S. Pat. No. Des. 154,300; multi-tiered, as in U.S. Pat. No. 3,482,708; and expandable, as in U.S. Pat. No. 3,844,415; but such trays are unsuitable for use with video display terminals. As far as applicant is aware, there is no single universal expandable tray available for use on video display terminals having either top or side motor vents.

SUMMARY OF THE INVENTION

Accordingly, an object of the present invention is to provide an improved adjustable tray particularly usable on video display terminals for ready access of information that otherwise might be spread on the terminal desk or surrounding tables.

Another object of the present invention is to provide an improved adjustable tray mountable on a video display terminal that enables the warm air expelled by the terminal motor to have free passage regardless as to location of the motor vent, whether on the top or side of the terminal.

Still another object of the present invention is to provide an improved adjustable tray that can be readily installed upon a video display terminal.

A further object of the present invention is to accomplish the foregoing objects in a practical and economical manner.

Other and further objects will be obvious upon an understanding of the illustrative embodiment about to be described or will be indicated in the appended claims and various advantages not referred to herein will occur to one skilled in the art upon employment of the invention in practice.

In accordance with the present invention the foregoing objects are generally accomplished by providing an adjustable tray for a video display terminal which comprises a two-piece tray formed preferably of plastic sheet material in which each piece of the tray includes a depending side, a shelf elevated above the bottom edge of the depending side and a stepped protuberance underneath each shelf at the juncture of the shelf and depending side for enabling the tray to be positioned on the video display terminal in accordance with the location of the top or side motor vents.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a front elevational view of the adjustable tray in accordance with the present invention.

FIG. 2 is a top plan view of the adjustable tray shown in FIG. 1.

DESCRIPTION OF PREFERRED EMBODIMENT

Figure 3:
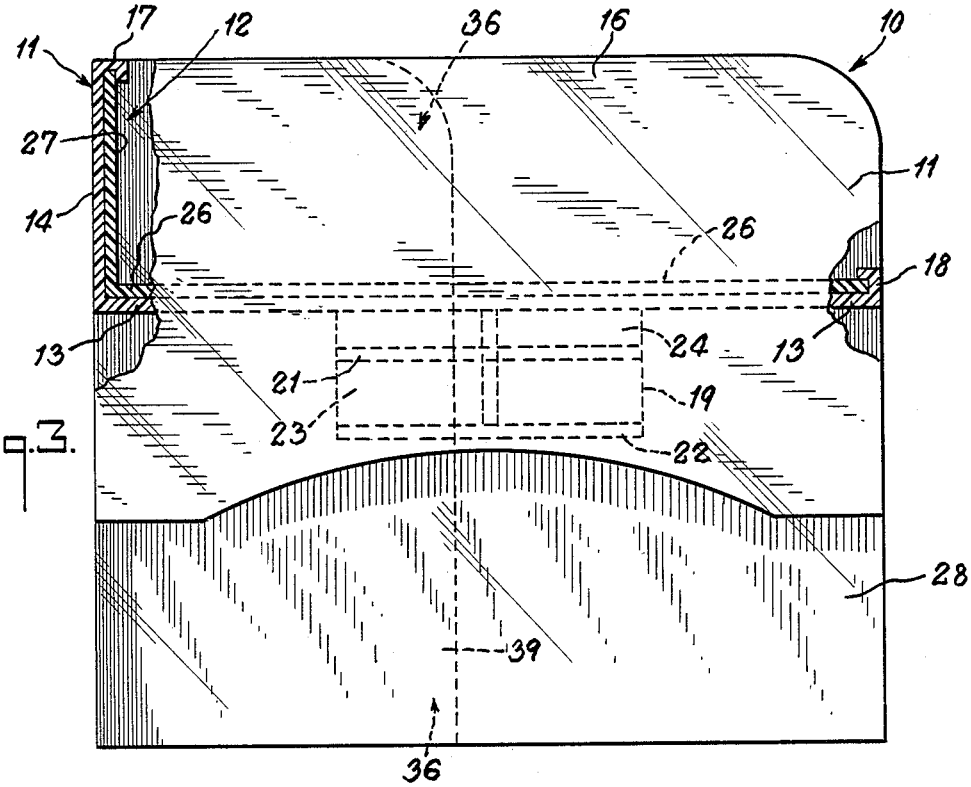
FIG. 3 is a left side elevational view of the adjustable tray shown in FIG. 1, partly in section and partly broken away, showing the guideways for the movable shelves.

Referring now to the drawings, particularly to FIGS. 1,2 and 3, there is shown an adjustable 2 piece tray 10, preferably of plastic material including a left piece 11 and a right piece 12, as viewed in FIG. 1. The two pieces 11 and 12 are slidable with respect to each other, as will be brought out hereinafter. The left piece 11 comprises a horizontal shelf 13, a back 14, a side or skirt 16, an upper guideway 17, a lower guideway 18, and a stepped protuberance or bracket 19 having an upper horizontal step 21, a lower horizontal step 22, a vertical element 23 interconnecting steps 21 and 22 with step 22 joined to side 16, and a vertical element 24 extending from step 21 and joined to the underside of shelf 13. The right piece 12 comprises a horizontal shelf 26, a back 27, a side or skirt 28, and a stepped protuberance or bracket 29 similar to and positioned oppositely to said protuberance 19 of the left piece 11. The protuberance 29 has an upper horizontal step 31, a lower horzizontal step 32, a vertical element 33 interconnecting steps 31 and 32 with step 32 joined to side 28, and a vertical element 34 extending from step 31 and joined to the underside of shelf 26. The right piece 12 also includes a 3 sided compartment 36 having a bottom 37, a back 38 and an outer side wall 39 with an open front and top. As indicated hereinbefore, both pieces 11 and 12 are formed of plastic sheet material of about 3/16" thickness and each piece is formed as an integral unit. The right piece 12 is slidable with respect to the left piece 11, wherein the back 27 and shelf 26 of piece 12 slide in the upper guideway 17 and the lower guideway 18, respectively, of piece 11, as more clearly shown in FIG. 3. To provide for improved collapsing of the right piece 12 into the left piece 11 of the tray 19, a cutout 41 is made in the free edge of shelf 13, as seen in FIG. 2, for meshing therein of the protuberance 29.

Figure 4:
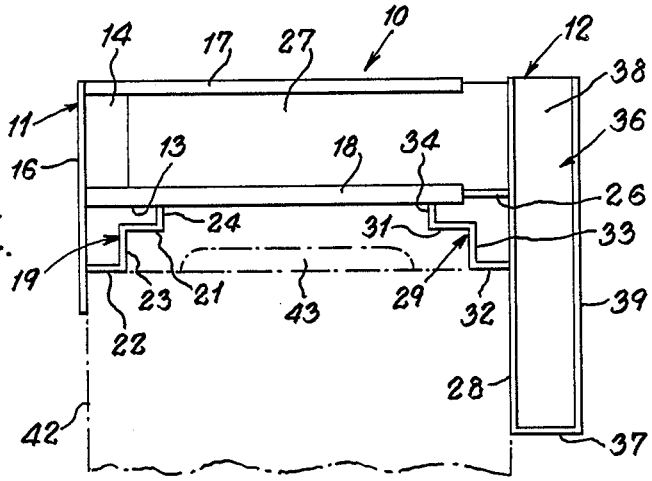
FIG. 4 is a front elevational view of the adjustable tray mounted upon a video display terminal having a motor vent at the top.
Figure 5:
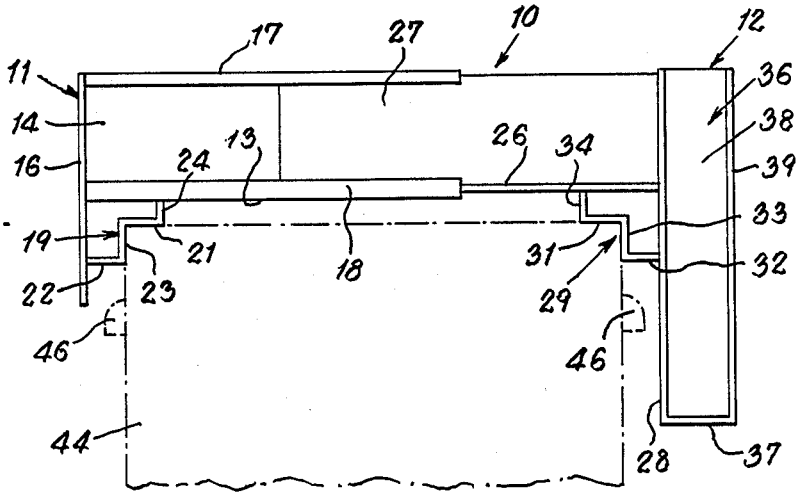
FIG. 5 is a front elevational view of the adjustable tray mounted upon a video display terminal having a motor vent at the side.

In operation, the two piece tray 10 is first adjusted to fit the approximate width of the video display terminal and then mounted on the top thereof in accordance with that shown in FIG. 4 or FIG. 5. Referring to FIG. 4, it will be seen that the tray 10 rests on the top of the terminal 42 with the left step 22 and the right step 32 of the protuberances 19 and 29, respectively, resting thereon, thereby enabling the exhaust from the vent 43 to escape underneath the shelves 13 and 26 of the tray. Referring to FIG. 5, it will be seen that the tray 10 has now been extended laterally to provide for exhausting fumes from the vents 46 at the sides of the video display terminal 44. It does happen that motor vents may occur at both top and side of the terminal and FIG. 5 takes care of this situation by placing the tray 10 on the top of the terminal with left step 21 and right step 31 resting thereon and with left vertical element 23 and right vertical element 33 hugging the sides of the terminal. Of course, if the motor vent is at the side of the terminal, without any vent at the top, the tray 10 may rest directly upon the terminal with the left vertical element 24 and the right vertical element 34 hugging the sides of the terminal.

From the foregoing description it will be seen that the present invention provides an improved adjustable tray for a video display terminal having a top or side vent for exhausting air from its motor. The tray can have its two pieces 11 and 12 collapsed to a closed position by virtue of the cutout 41 in the free end of the left shelf 13 or extended to any desired width. The shelf of the tray, as well as the compartment 36, provide ready receptacles for storing papers and instructions for operating the terminal, such as, diskettes and program books.

As various changes may be made in the form, construction, and arrangement of the parts herein, without departing from the spirit and scope of the invention and without sacrificing any of its advantages, it is to be understood that all matters are to be interpreted as illustrative and not in any limiting sense.

What is claimed is:

1. An expandable tray for mounting on the top of a video display terminal having either a top vent or a side vent for exhausting air from its motor comprising, in combination, two pieces, each of said pieces including a shelf, a back, and a side, interconnecting means on said pieces for slidably closing or expanding said pieces, said interconnecting means including a guideway on an upper edge of said back of one of said pieces, a guideway on a front edge of said shelf of one of said pieces, an upper edge of said back on the other of said pieces slidable in said upper guideway, a front edge of said shelf on the other of said pieces slidable in said front guideway, whereby said two backs and said two shelves are slidable with respect to each other, and a stepped protuberance on each of said pieces for positioning said tray upon said video display terminal, each of said stepped protuberances including a pair of steps, a first step and a second step, in which each of said steps has a vertical riser and a horizontal tread, wherein said vertical riser of said first step of said one of said pieces is integral with said shelf of said one of said pieces, said horizontal tread of said second step of said one of said pieces is integral with said side of said one of said pieces, said vertical riser of said first step of said other of said pieces is integral with said shelf of said other of said pieces, and said horizontal tread of said second step of said other of said pieces is integral with said side of said other of said pieces.

2. An expandable tray according to claim 1, wherein said tray is mounted upon the top surface of said video display terminal with said horizontal treads of said second steps of said two pieces resting on said top surface.

3. An expandable tray according to claim 1, wherein said tray is mountable upon the top surface of said video display terminal with said horizontal treads of said first steps of said two pieces resting on said top surface and with said vertical risers of said second steps of said two pieces embracing sides of said terminal.

4. An expandable tray according to claim 1, wherein said tray is mountable upon the top surface of said video display terminal with said shelves of said two pieces resting on said top surface and with said vertical risers of said first steps of said two pieces embracing sides of said terminal.

5. An expandable tray according to claim 1, wherein said shelf of said one piece has an opening for reception of a portion of said stepped protuberance of said other piece when said two pieces are retracted to a closed position.

6. An expandable tray according to claim 1, wherein said side of said other piece includes a compartment on its outer surface having a bottom, back and outer side wall integrally formed and in which said bottom and said back of said compartment are integral with said side of said other piece.

* * * * *